United States Patent [19]

Russell et al.

[11] 4,410,393

[45] Oct. 18, 1983

[54] PREPARATION OF STEEL SURFACES FOR ADHESIVE BONDING BY ETCHING WITH $H_3PO_4$-POLYHYDRIC ALCOHOL MIXTURE

[75] Inventors: William J. Russell, Sparta; Roberta Rosty, Saddlebrook, both of N.J.

[73] Assignee: The United States of America as represented by the Secretary of the Army, Washington, D.C.

[21] Appl. No.: 391,793

[22] Filed: Jun. 24, 1982

[51] Int. Cl.[3] ..... C23F 1/00; B32B 31/24

[52] U.S. Cl. ..... 156/629; 134/3; 156/330; 156/664; 252/136; 252/79.4

[58] Field of Search ..... 156/629, 664, 330; 252/79.4, 136; 134/3

[56] References Cited

U.S. PATENT DOCUMENTS

| | | | |
|---|---|---|---|
| 2,554,358 | 5/1951 | Burke | 252/136 |
| 2,629,696 | 2/1953 | Dodd et al. | 252/136 |
| 2,737,498 | 3/1956 | Frasch | 252/136 |
| 2,806,000 | 9/1957 | Streicher | 156/664 |
| 3,134,702 | 5/1964 | Delong | 252/79.4 |
| 3,342,711 | 9/1967 | Shiga et al. | 252/79.4 |
| 3,457,107 | 7/1969 | Mickelson et al. | 252/79.4 |
| 3,709,824 | 1/1973 | Oda et al. | 252/79.4 |
| 3,979,238 | 9/1976 | Justice | 252/79.4 |

FOREIGN PATENT DOCUMENTS

| | | | |
|---|---|---|---|
| 51-62671 | 5/1976 | Japan | 252/79.4 |
| 53-52254 | 5/1978 | Japan | 252/79.4 |

OTHER PUBLICATIONS

"Glycerol", Kirk-Othmer Encyclopedia of Chemical Tech., John Wiley & Sons, Inc., vol. 10, pp. 619, 620, 629.

*Primary Examiner*—Jerome W. Massie

*Attorney, Agent, or Firm*—Robert P. Gibson; Anthony T. Lane; A. Victor Erkkila

[57] ABSTRACT

The invention provides a process and composition for preparing steel surfaces for adhesive bonding. The process involves contacting the steel article with an etchant composition containing phosphoric acid and a liquid polyhydric alcohol such as propylene glycol, diethylene glycol or glycerine. The process produces steel surfaces, which when adhesively bonded yield joints much stronger than those obtained by abrasive blasting, and comparable to those obtained by use of phosphoric acid-ethanol etchant compositions without the hazards of the latter.

7 Claims, No Drawings

PREPARATION OF STEEL SURFACES FOR ADHESIVE BONDING BY ETCHING WITH $H_3PO_4$-POLYHYDRIC ALCOHOL MIXTURE

GOVERNMENT RIGHTS

The invention described herein may be manufactured, used, and licensed by or for the Government for Governmental purposes without the payment to us of any royalties thereon.

BACKGROUND OF THE INVENTION

A large body of knowledge concerning the bonding of aluminum and titanium metals has been developed largely by the aerospace industry. Relatively little information is available regarding the bonding of steels, particularly with use of the most important class of adhesives, viz. the structural, high strength types, notably epoxy type resins.

In the past steel surfaces were prepared for adhesive bonding by wire brushing, abrasive blasting and cleaning with chemicals and organic solvents. The past methods were adequate but in many cases had significant shortcomings. We have recently found that highly satisfactory, strong, durable bonds on steel can be obtained by etching the steel surface with a mixture of phosphoric acid and ethanol prior to bonding with an adhesive. However, the use of such etching baths is impractical for industrial applications primarily in view of their high alcohol content, since the ethanol vapors over the etching tank are highly flammable and somewhat toxic. Accordingly, there is a need for an etching method and an etching bath composition, which avoids such disadvantages but provides similar strong, durable bonds on steel.

SUMMARY OF THE INVENTION

A principal object of the present invention is to provide a novel process and composition for etching steel, which avoids the use of ethanol solvent with phosphoric acid yet produces a steel surface which, when adhesively bonded, yields joints of comparable strength and stress durability to those obtained by use of the phosphoric acid-ethanol etchant.

According to the present invention the foregoing and other objects can be achieved by contacting the steel parts with an etchant composition consisting essentially of phosphoric acid and a liquid polyhydric alcohol, particularly a dihydric and/or trihydric alcohol. Exemplary polyhydric alcohols suitable for use in the process and compositions of the present invention include ethyleneglycol, diethylene glycol, triethylene glycol, polyethylene glycol 400, 1,2- and 1,3-propylene glycol, 1,4-butanediol and glycerine.

DETAILED DESCRIPTION OF THE INVENTION

The etchant compositions, which can be suitably employed in the process of the present invention, contain phosphoric acid, a polyhydric alcohol and water in the proportions equivalent to the following:

| Ingredient | % By Volume |
|---|---|
| phosphoric acid (85%) | 10 to 40 |
| polyhydric alcohol | 50 to 90 |

-continued

| Ingredient | % By Volume |
|---|---|
| water | 0 to 10 |

For optimum results the proportion of water in the etchant composition is minimized. Preferred etchant compositions contain about 24 to 29 vol. % phosphoric acid (85%), about 65 to 77 vol. % polyhydric alcohol and about 0 to 6 vol. % water.

The process of the present invention can be carried out by contacting the steel article with the etchant bath for a suitable period under a wide range of temperatures, for example from 20° C. to 100° C. for 5 to 20 minutes.

The following examples illustrate specific embodiments of the process and etchant compositions of the present invention.

PREPARATION OF THE STANDARD PHOSPHORIC AND ETHANOL ETCHANT

Example 1

2 parts by volume of ethanol were mixed with 1 part by volume of 85% phosphoric acid.

PREPARATION OF THE NOVEL ETCHANTS

Example 2

230 parts by volume of glycerine and 20 parts by volume of water were mixed with 100 parts by volume of 85% phosphoric acid.

Example 3

7.25 parts by volume of 1,2-propylene glycol were mixed with 2.9 parts by volume of 85% phosphoric acid.

Example 4

7.5 parts by volume of diethylene glycol were mixed with 2.3 parts by volume of 85% phosphoric acid.

ETCHING PROCEDURE

The etchant compositions of examples 1–4 were employed for etching panels of 4340 alloy steel, which had been degreased and then abrasive blasted prior to immersion in the etchant bath to remove all traces of surface oxides formed during heat treatments.

Table 1 shows the etching conditions employed.

TABLE 1

| Etchant Solution | Immersion Time (minutes) | Solution Temperature (°F.). |
|---|---|---|
| Example 1 | 10 | 140 |
| Example 2 | 10 | 150 |
| Example 3 | 10 | 150 |
| Example 4 | 10 | 140 |

After removal from the etching bath the panels were rinsed with tap water, scrubbed with a nylon brush, rinsed with deionized water, air-knife blow dried and then baked in an oven for one hour at 85° C.

ADHESIVE BOND TESTS

The etchant compositions of the examples were tested for their effectiveness for preparing steel surfaces for adhesive bonding. Wedge tests were carried out to determine the durability of the adhesive bond under elevated temperature and humidity conditions. Tensile strength tests were conducted to determine the lap shear tensile strength of the bonded joints.

WEDGE TESTS

The wedge test specimens employed consisted of two strips of 4340 alloy steel sheet 2.5 cm (1 in.) wide, 0.32 cm (0.125 in.) thick, and 20.4 cm (8 in.) long, prepared by the etching procedure described above. For bonding, a sandwich was prepared by placing a strip of a thermosetting epoxy film adhesive AF-126-2 2.5 cm (1 in.) wide by 15 cm (5.9 in.) long and a strip of teflon film 2.5 cm (1 in.) wide by 5.4 cm (2.1 in.) long by 0.1 mm (0.004 in.) thick between the steel strips, such that after bonding when the teflon film was removed, a rectangular bonding area 2.5 cm wide by 15 cm long was created between the two strips of metal. The AF-126-2 adhesive is a non-volatile thermosetting film adhesive designed for structural bonding of metals manufactured by the 3M Company, Minneapolis, MN. The adhesive was cured at 121° C. in one hour at 50 psi.

Prior to testing, a wedge consisting of a strip of 4340 steel alloy 2.5 cm long, 1.0 cm wide and 0.32 cm thick (1 in.×0.4 in.×0.125 in.) was inserted into the unbonded area between the metal strips so that it was flush with the edges of the specimen. This wedge at no time approached closer than 4 cm (1.6 in.) to the adhesive bonded area. The stressed specimen was then placed in a test chamber of 140° F. and 100% relative humidity.

The growth of the crack which developed in the adhesive bond was monitored by removing the specimens from the test environment and locating the crack tip with the aid of 40 power binocular microscope. The location of the crack tip was scribed on both sides of the specimen, which was then returned to the test chamber for another period of testing.

The test results are set forth in Table 2. The results show that the bond durability obtained by use of the novel etchant compositions of examples 2–4 are closely similar to those obtained by employing the phosphoric acid-ethanol etching treatment, and significantly greater than those obtained by the sand blast treatment.

TENSILE TESTS

The test specimens were adhesively bonded using AF-126-2 Adhesive noted above.

TABLE 2

Wedge Test Results Summary
AF126-2 Adhesive (Crack length in inches)

| Time(hrs) | Control Sand Blast (in.) | | | | Ethanol-Phosphoric Acid (in.) | | | Diethylene-Glycol-Phosphoric Acid (in.) | | | Propylene-Glycol Phosphoric Acid (in.) | | | Glycerine-Phosphoric Acid (in.) | | |
|---|---|---|---|---|---|---|---|---|---|---|---|---|---|---|---|---|
| Run | I | II | III | $\overline{X}$ | I | II | $\overline{X}$ | I | II | $\overline{X}$ | I | II | $\overline{X}$ | I | II | $\overline{X}$ |
| 0 | 2.23 | 2.24 | 2.42 | 2.30 | 1.99 | 2.03 | 2.02 | 1.94 | 2.15 | 2.05 | 2.06 | 1.99 | 2.03 | 1.92 | 2.05 | 1.99 |
| ¼ | 3.22 | 3.46 | 3.35 | 3.34 | 2.50 | 2.45 | 2.48 | 2.43 | 2.59 | 2.51 | 3.01 | 2.77 | 2.89 | 2.39 | 2.28 | 2.34 |
| ½ | 3.80 | 3.62 | 3.58 | 3.67 | 2.65 | 2.53 | 2.59 | 2.73 | 2.89 | 2.81 | 3.27 | 2.88 | 3.08 | 2.51 | 2.36 | 2.43 |
| 1 | 4.26 | 3.90 | 3.69 | 3.95 | 2.87 | 2.96 | 2.92 | 3.05 | 3.22 | 3.14 | 3.54 | 3.31 | 3.42 | 2.72 | 2.48 | 2.60 |
| 2½ | 4.79 | 4.50 | 4.11 | 4.47 | 3.42 | 3.67 | 3.55 | 3.50 | 3.83 | 3.67 | 3.98 | 3.89 | 3.93 | 3.14 | 2.73 | 2.94 |
| 5 | — | 4.67 | — | 4.67 | — | 3.75 | 3.75 | — | — | — | — | — | — | — | 2.78 | 2.78 |
| 6 | 4.79 | — | 4.44 | 4.62 | 3.77 | — | 3.77 | 3.60 | 3.90 | 3.75 | 4.04 | 3.96 | 4.00 | 3.43 | — | 3.43 |
| 23 | — | 4.79 | — | 4.79 | — | 3.75 | 3.75 | — | — | — | — | — | — | — | 2.90 | 2.90 |
| 23½ | — | — | 4.92 | 4.92 | — | — | — | 4.07 | — | 4.07 | 4.21 | — | 4.21 | — | — | — |
| 24 | 4.94 | — | — | 4.94 | 3.93 | — | 3.93 | — | 4.00 | 4.00 | — | 4.42 | 4.42 | 4.00 | — | 4.00 |

$\overline{X}$ = Average Crack Length (inches)

The bonded specimens were 2.5 cm (1 in.) wide and had an adhesive lap joint of 1.25 cm (0.5 in.). The tensile tests were conducted essentially according to the method described in ASTM D1002-72 Standard Method of Test for "Strength Properties of Adhesive Shear by Tension Loading (Metal-to-Metal)", except that the optional panel shown in FIG. 3 of the specification was employed.

The test results are shown in Table 3. They show that the bonds obtained with the novel method and etchant compositions of the present invention are comparable to those similarly obtained with the use of phosphoric acid-ethanol etchant, and significantly superior to those obtained by the sand blast treatment.

TABLE 3

Comparison of the Surface Preparations by Lap Shear Tensile Testing. AF-126-2 Adhesive

| Run | Sand Blasted (PSI) | Standard Etchant (PSI) | Glycerine-Water Phosphoric Acid (PSI) | Diethylene-Glycol-Phosphoric Acid (PSI) | Propylene-Glycol-Phosphoric Acid (PST) |
|---|---|---|---|---|---|
| 1 | 4020 | 4590 | 4950 | 4190 | 5080 |
| 2 | 3940 | 5140 | 4900 | 4260 | 4840 |
| 3 | 4060 | 4970 | 4890 | 4224 | 4750 |
| 4 | 4170 | 5370 | 4960 | 3870 | 5090 |
| 5 | 4550 | 5220 | 4900 | 5080 | 4540 |
| 6 | 4320 | 4880 | 4870 | 5300 | 4340 |
| 7 | 4250 | 4690 | 5100 | 5210 | 4300 |
| 8 | 4640 | 4790 | 4220 | 5300 | 4390 |
| | $\overline{X}$ = 4240 | $\overline{X}$ = 4960 | $\overline{X}$ = 4850 | $\overline{X}$ = 4680 | $\overline{X}$ = 4670 |
| | SD = 250 | SD = 271 | SD = 264 | SD = 596 | SD = 321 |

Notes:
$\overline{X}$ = Average Tensile Breaking Load in PSI (Pounds force/square inch)
SD = Standard Deviation

We claim:

1. A process for adhesive bonding of steel parts, wherein the steel parts are subjected to an etching process to produce a surface preparatory to adhesive bonding, which comprises contacting the steel parts with a liquid etchant composition consisting essentially of about

| | |
|---|---|
| phosphoric acid (85%) | 10 to 40 vol. % |
| polyhydric alcohol | 50 to 90 vol. % |
| water | 0 to 10 vol. % |

2. The process according to claim 1, wherein the composition consists essentially of about

| | |
|---|---|
| phosphoric acid (85%) | 24 to 29 vol. % |
| polyhydric alcohol | 65 to 77 vol. % |
| water | 0 to 6 vol. % |

3. The process of claim 1 or 2, wherein the polyhydric alcohol is selected from the group consisting of propylene glycol, diethylene glycol, and glycerine.

4. The process according to claim 1, wherein the composition consists essentially of about

| | |
|---|---|
| phosphoric acid (85%) | 28–29 vol. % |
| glycerine | 65–66 vol. % |
| water | 5–6 vol. % |

5. The process according to claim 1, wherein the composition consists essentially of about

| | |
|---|---|
| phosphoric acid (85%) | 29 vol. % |
| 1,2-propylene glycol | 71 vol. % |
| water | 0 vol. % |

6. The process according to claim 1, wherein the composition consists essentially of about

| | |
|---|---|
| phosphoric acid (85%) | 23 vol. % |
| diethylene glycol | 77 vol. % |
| water | 0 vol. % |

7. The process according to claim 1, wherein the adhesive bonding is effected with an epoxy resin adhesive.

* * * * *